United States Patent [19]

Hopkins

[11] 4,247,885

[45] Jan. 27, 1981

[54] LIMITED MOTION ROTATION JOINT

[76] Inventor: Arthur W. Hopkins, Stone Bridge Rd., Cornwall, N.Y. 12518

[21] Appl. No.: 889,386

[22] Filed: Mar. 23, 1978

[51] Int. Cl.[3] ..... F21V 21/20

[52] U.S. Cl. ..... 362/401; 362/413; 362/421; 362/432; 403/46

[58] Field of Search ..... 362/401, 403, 413, 421, 362/432; 403/43, 45, 46

[56] References Cited

U.S. PATENT DOCUMENTS

| | | | |
|---|---|---|---|
| 2,388,474 | 11/1945 | Ellis | 362/432 X |
| 2,449,250 | 9/1948 | Richter | 362/432 X |
| 2,656,454 | 10/1953 | Yacyshyn | 362/432 X |
| 2,747,283 | 5/1956 | Sanders | 403/45 X |
| 3,278,203 | 10/1966 | Snyder | 362/421 X |
| 3,286,545 | 11/1966 | Malachowski | 362/421 X |
| 4,092,528 | 5/1978 | Puyplat | 362/432 X |
| 4,135,834 | 1/1979 | Bartman | 403/46 X |
| 4,160,285 | 7/1979 | Shibla | 362/432 X |

*Primary Examiner*—Peter A. Nelson

[57] ABSTRACT

The limited motion rotational joint employs two rotational members positioned as to be in frictional and rotatable engagement with each other around a common axis and in parallel spaced planes. The outer sections of the members are spaced apart, by the use of spacers, and a frictional foam is wrapped around the spacers while fitting between the outer sections. A compression unit is then used for circumferential application around the frictional foam to provide regulation of the frictional force applied to the rotational members.

3 Claims, 10 Drawing Figures

64
68
62
61
65
12
10
20
T
19
18
15
14
17
16
16
24
23
-17-
-17-
23
22
26
21
22
24
54
50
53

212
226
218
222
214

122
121
112
71

72
124
210
212
214

LIMITED MOTION ROTATION JOINT

BACKGROUND OF THE INVENTION

1. Field of the Invention

This invention relates to improvements in a swivel joint, and more particularly to an improved swivel joint especially adapted for supporting a lamp in an angularly adjusted position about two transverse axes.

2. Brief Description of the Prior Art

The heretofore conventional swivel joints were of relatively complicated structure having a multiplicity of parts, which results in an expensive mechanism. Despite the complexity of the mechanism, the rotatively mounted stem to which the lamp reflector was attached was relatively difficult to rotate, in some instances, to angularly adjust positions, or conversely, if easy to rotate, it was difficult to clamp securely after adjustment.

Moreover, in some prior art joint constructions, the rotatively mounted stem could move longitudinally and axially in its mounting, and consequently, would be disturbed in its exact relationship with the coacting transverse second axis.

In the prior art an exact weight balance and balancing of the bracing springs is required for the joints to maintain the structure in any one of a plurality of possible positions. Frequently, however, less than a perfect interaction of parts is achieved and the device will not hold several desired positions. In the higher priced versions of the prior art devices, the balancing between the weight of the arms and shade are correctly matched with the spring system, however, if any change is made, i.e. a larger bulb or different shade, the balance is thrown off and the unit will not function as intended. In the lower priced units, because of the inbalance between the arms, shade and springs, the unit is basically non-functional as intended. In both units, the higher and lower priced, the aesthetics cannot be improved because of the need for the balancing springs. The prior art units are unattractive as well as generally unfunctional.

The swivel joint as disclosed in U.S. Pat. No. 3,480,304 by Mehr, is of a relatively uncomplicated nature and exists of fewer parts than the prior devices. It does, however, have inheritant problems which, up until the instant invention, have not been overcome. A major problem with the prior art is that adjustments as to the angle of the arms of the lamp is made by loosening a screw device, placing the arms in the desired position and then tightening the screw or knob until the pressure clamps the arms tightly and holds them in the desired position. This technique is illustrated in FIG. 4 of the above patent wherein a pin 31, having a head 32 at one end and a threaded opposite shank end 33, extends transversely through the brackets 27 and 28 and through the body sections 24 and 25 and then engages the bracket 27. An adjusting knob 34 is attached to the threaded pin end 33 and it is through the tightening of this adjusting knob 34 that the arms of the lamp are held in the desired position. The adjusting knobs or screws in this type of device require few turns of the threaded section to tighten them to a clamping position, and conversely very few turns, or a small amount of slippage releases the tension created and allows the arms to slip. This problem becomes more apparent as time progresses and the unit is used more.

The parts of the units described above are generally made from plastic, except for the threaded pin or screw, to allow the unit to be made more economically as well as lighter. The plastic sections through which the threaded piece pass, have a tendency to wear and enlarge the hole, requiring more and more tension to be placed to hold the arms in position until eventually the units are so worn they can no longer be forced into the stationary position. The lamp unit is then no longer useable in its original form and must be secured by other means.

SUMMARY OF THE INVENTION

In the instant invention, the foregoing complications are overcome and a simple, effective, durable and easy to manufacture rotational joint is economically produced. The limited motion rotational joint in the preferred embodiment employs two molded rotational members positioned as to be in frictional and rotatable engagement with each other around a common axis and in parallel spaced planes. The outer sections of the members are spaced apart, by the use of spacers, with a frictional foam being wrapped around the spacers while fitting inside the outer sections. A compression unit is used for circumferential application to regulate the frictional force being applied to the rotational members.

A BRIEF DESCRIPTION OF THE DRAWINGS

DETAILED DESCRIPTION OF THE INVENTION

Figures 1, 2, 5, 6:
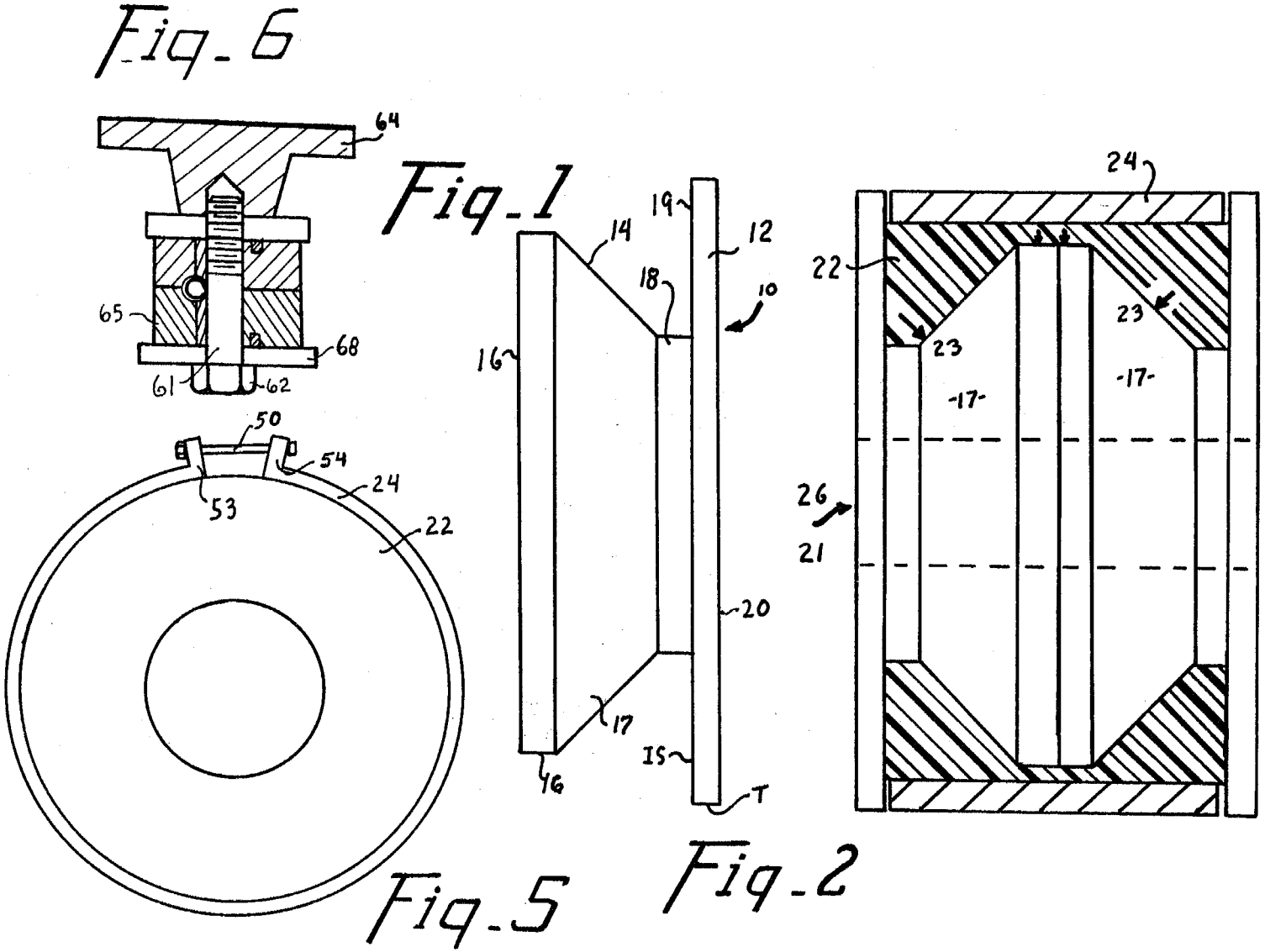
FIG. 1 is a side view of one half of an embodiment of the invention.
FIG. 2 is a side view of an alternate embodiment of the invention.
FIG. 5 is a side view of the clamping or compression unit of the invention.
FIG. 6 is a side view of a prior art unit.

FIG. 1 is one half of the unit's frictional rotational members, rotational member 10. The inner friction disc edge 16 is a circular disc having a diameter D of approximately 1½ inches at the inner friction disc edge 16. The thickness T of the inner friction disc edge 16 is approximately 1/16 inch and has from one side, opposite the inner friction disc edge 16, a truncated concial member 17 extending away from the inner friction disc 14. The sides of the truncated conical member 17 are approximately ¼ inch in length and have, at their end opposite that of the inner friction disc edge 16, a connector disc 18. The connector disc 18 is a circular member with the approximate thickness of that of the inner friction disc edge 16 thickness T. Adjacent to the connector disc 18, at the side opposite that of the truncated concical member 17 is the outer friction disc 12. The thickness of the outer friction disc 12 is again approximate to that of the inner friction disc edge 16 thickness T.

The entire friction disc 10 can be molded in one piece from plastic or other moldable material, or the unit can be molded or formed in separate pieces, preferably with the inner friction disc 14 and the connector disc 18 being of one piece and the outer friction disc 12 being a second piece. If the unit is molded in two pieces, the outer friction disc 12 can be joined with the remainder of the unit at joint 19 by use of an adhesive adaptable to the material from which the unit is molded. The tube insert hole 21 is drilled or formed, at time of manufacture, through the center of the completed unit, the diameter of which is not limited to size and can be used as a cord insert. The sizes stated above are for use in way of explanation and in no way are to be used as limitations to size. It is obvious that the size of the unit can be increased or decreased to correspond to the size of the lamp in which it is used.

FIG. 2 illustrates the completed unit, rotational member 26. Rotational member 10 of FIG. 1 is placed with the inner friction disc edge 16 against its mirror image. Resilient foam forming a frictional member 22 is wrapped around the inside of the unit with the outer edges of the frictional member 22 fitting between the outer friction discs 12. A compression member 24 is then placed around the friction member 22 causing an increased frictional engagement, or binding of the inner friction disc edge 16 of the rotational member 10 with its mirror image counterpart and also bringing and holding together the two mirror image sections. The width of the compression member 24 can be equal to or slightly less than the distance between the inner surface IS of the outer friction disc edge 20 and its mirror image counterpart. Further rotational resistance is obtained due to the binding of the frictional member 22 against the inner surface IS of the outer friction disc 12 and the angular or truncated concical surface 17 of the inner friction disc 14, as well as the inner friction disc edge 16. Obviously, the same is true for each friction disc unit and reference to one unit is by way of convenience.

The V shaped area created by the sloped sides of the truncated concical member 17 and the inner surface IS of the outer friction disc 12 retains the two halves of the rotational member 26 is their fixed position. The frictional member 22 is wrapped around the rotational member 26, fixed in place by the compression member 24, and the force placed upon the frictional member 22 prevents any outward slippage, or separation, of the two halves.

The tube insert hole or axle 21 is illustrated clearly in FIG. 2. A hollow tube, as well known in prior art, is inserted through the tube insert hole 21 and thus prevents any sideward slippage of the units of the rotational member 26. In addition to slippage prevention, the tube provides a convenient method of transferring the electrical cord from one arm to the other, as the electrical cord obviously cannot be wrapped around the rotational member 26.

Figure 3:
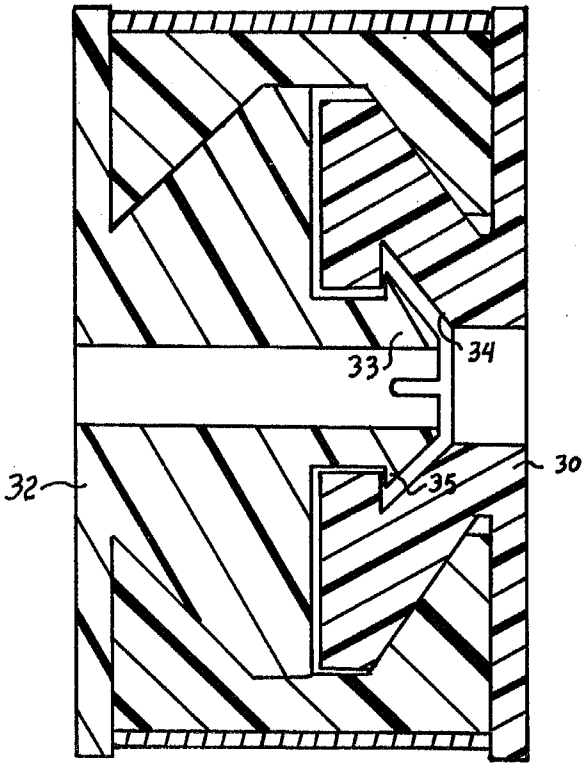
FIG. 3 is a side view of an alternate embodiment of the invention.

FIG. 3 shows an alternate embodiment of the instant invention, wherein the basic unit design is that of FIG. 2, however the relative displacement of the rotational members 30 and 32 is prevented through the use of an interlocking mechanism which does not interfere with the relative rotation of the members, except as required by the invention.

A snap together joint of any desired configuration, as well known in the art, can, for example, include a male member 33 which is received in correspondingly dimensioned recess 34. The shoulder 35 prevents withdrawal of the male member 33 from the recess 34 after the insertion is completed.

Figure 4:
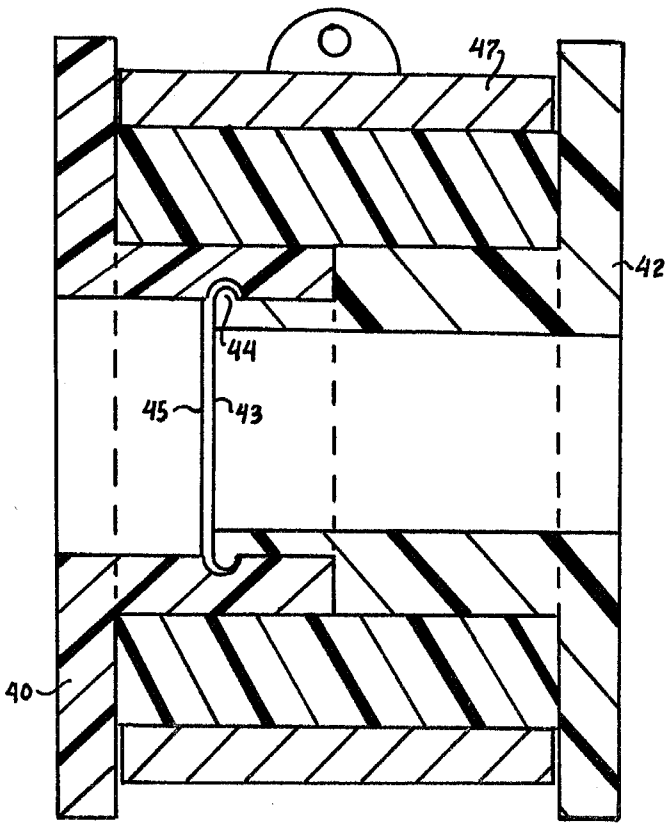
FIG. 4 is an additional side view of an alternate embodiment of the invention.

FIG. 4 illustrates an alternate embodiment of a snap together mechanism and includes a male member 43 which has an enlarged section 45 which is received by an annular groove 44. The interaction of the annular ridge 45 and the annular groove 44 is such that the rotational members 40 and 42 stay aligned but are free to rotate, except for the predetermined frictional resistance as required by the invention. The friction member 46 is seen to be subject to the compressional forces of the compression member 47.

FIG. 5 illustrates the compression member 24 of FIG. 2. As evident, the bolt 50 and nut 52 can interact to control or vary the distance between the flanges 53 and 54 and consequently increase or decrease the diameter of the compression member 47. Decreasing the diameter of the compression member 47 causes the friction member 22 to exert an increased pressure against the inner surface IS of the outer friction disc 12 of the rotational member 10 as well as against the inner surface of the mirror image counter part of the rotational member 26. Similarly, an increased force is exerted against the truncated concical member 17 of the rotational member 10 and the mirror image counterpart forming the rotational member 26. It should be evident that the force required to rotate the rotational member 10 against its mirror image counterpart when positioned as in FIG. 2 increases when the compressional force is increased on the friction member 22 and is correspondingly decreased with decreased force on the friction member 22.

Figure 7:
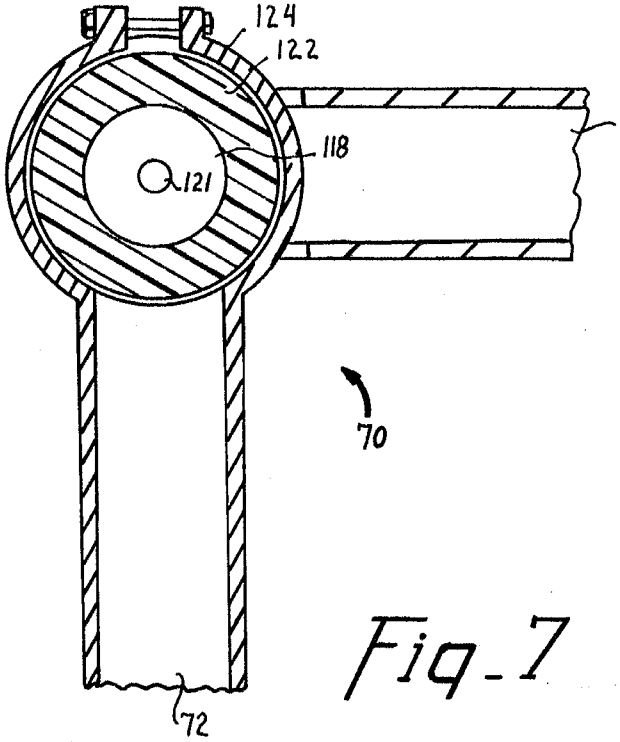
FIG. 7 is a side view of the completed unit of the instant invention.

Looking at FIG. 5 and FIG. 7, it can be seen that the rotation of a screw or bolt can be used to achieve control of the compressional forces on the friction member 22.

FIG. 6 shows a typical prior art joint in which tension or frictional resistance is used. The arms of the lamp are extending outward from points on the brackets 68, a pin 61 which has a head 62 at one end, passes through the body 65 and the brackets 68 by forcing them in closer contact with the body 65. The compressional force is directly related to of turns of the bolt or pin 61 and the pitch of the threads of the pin 61. It is evident that it takes a slight rotation of the pin 61 relative to the knob 64 to change the compressive force from inadequate to excessive. A fine adjustment quite obviously is, at best, extremely difficult to achieve.

In the embodiments of FIG. 5 and FIG. 7, several turns of the screw produces a relatively low degree of compressional change since a large degree of circumferential motion produces only a small degree of radial change. The correlation between frictional increase and circumferential change is dependant on a plurality of factors, including the compressibility of the friction member, the amount of friction surface and the configuration of the various frictionally interacting members. It should be noted that the term "binding" can, with equal accuracy, be used to describe the effect which restricts relative rotation of the rotational members.

FIG. 7 shows the rotational lamp unit indicated generally as 70, as seen from a side view. The compression member 124 is an extension of the lamp extension arm 72 which slips around the friction member 122 of FIG. 7. As seen in this figure, the compression member 124 is placed around the friction member 122 which has previously been wrapped around the connecting rod or cylinder 118. The entire rotational member 126 is not visable in this figure, the only part exposed being the connecting cylinder 118 and the rivet member 121. The lamp arm 71 is connected to the rotational member 126, which is better illustrated in FIG. 9.

Figure 8:
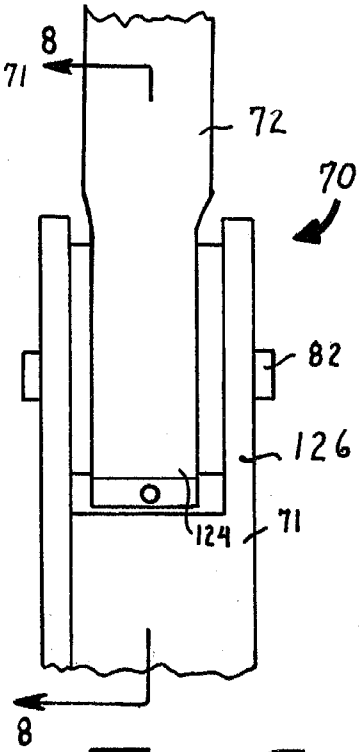
FIG. 8 is a top view of the completed unit of the instant invention.

FIG. 8 illustrates a fragmentary top view of the rotational lamp unit 70 in which the connecting section of the unit is not shown. This figure shows how the compression member 124 and its extension lamp compression arm 72 fits in and around the rotational member 126 and its extension lamp arm 71. The friction member 122 is set in as previously described, with the rivet 82 being placed through the previously described rod insert opening 121.

It should be noted that the cylinder 118 must be fixed to the arm 71 so it will move with the arm. The cylinder must be of sufficient diameter to provide enough surface with which the friction member 22 can interact. Thus, the cylinder member 118 and rivet 82 are functionally one unit and need not be separate except for manufacturing convenience.

Figures 9, 10, 11:
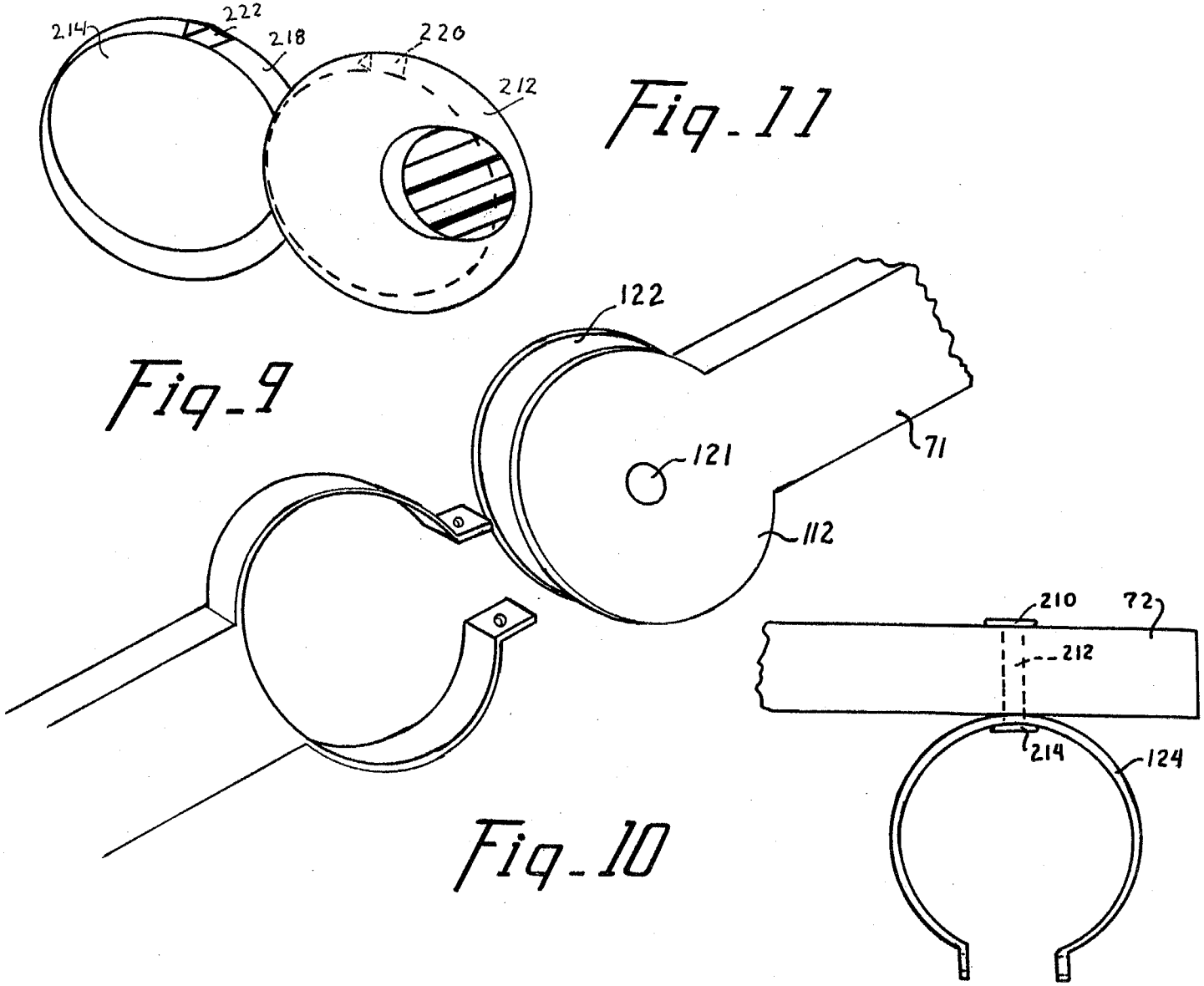
FIG. 9 is a perspective view of the units of the instant invention ready for assembly.
FIG. 10 is an alternate embodiment of the instant invention.

FIG. 9 illustrates the lamp compression arm 72, with its extending compression member 124 in a position ready to clamp around the friction member 122 within the lamp arm. The outer friction disc 112 is formed as part of the lamp arm 71 and is therefore automatically in the correct position to connect the two units.

FIG. 10 is an alternate to the instant invention wherein the compression member 124 is formed as a separate unit from the lamp extension arm 72 and is connected at the side of the lamp extension arm 72. A rivet 212 with heads 210 and 214 is inserted through a preformed hold in the lamp extension arm 72 and the compression member 124.

Figure 12:
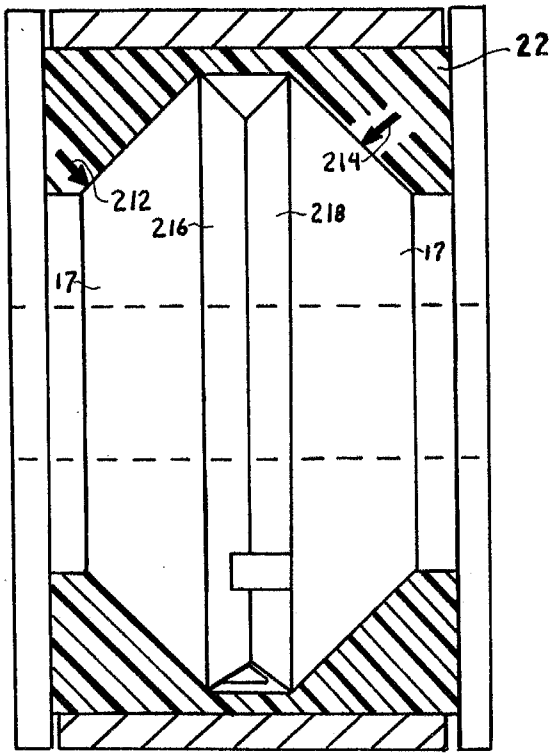

FIG. 11 and FIG. 12 show an alternate embodiment of the inner friction disc 14 of FIG. 1. The inner friction disc edges 216 and 218 are beveled inwardly on the side opposite the truncated concical member 17, for all but a small portion of the circumference. The portions of the circumference which are not beveled have a molded protusion or lip 220 and 222 respectively which extend slightly to the adjacent inner friction disc. The lips 220 and 222 allow the inner friction discs 212 and 214 to rotate under 360°, or until the two lips 220 and 222 are in a position where they meet. This prevents the lamp arms from being rotated in a complete circle providing protection for the electrical wires passing through the tube axle 21, yet allows enough movement to position it in any direction required as well as placing both arms side by side for shipping or storage.

I claim:

1. A lamp comprising:

a lamp reflector, a support member, a plurality of hinged body sections connecting said lamp reflector to said support member, and wherein at least a plurality of said hinged body sections are connected by a limited movement joint comprising:

a first rotational member a second rotational member, said rotational second member being in frictional and rotatable engagement with said first rotational member, said first rotational member and said second rotational member being capable of rotation about a common axis and in parallel spaced apart planes, a first spacer fixed to said first rotational member and extending therefrom toward said second rotational member, a second spacer fixed to said second rotational member and extending therefrom toward said first rotational member, friction means in circumferential frictional engagement with said first spacer and said second spacer, compression means in circumferential engagement with said friction means for selectively varying the compressional force on said friction means and consequently selectively varying the frictional force applied to said first spacer and said second spacer whereby the force required to cause rotation of said first rotational member relative to said second rotational member is selectively varied.

2. A lamp comprising:

a lamp reflector, a support member, a plurality of hinged body sections connecting said lamp reflector to said support member, and wherein at least a plurality of said hinged body sections are connected by a limited movement joint comprising:

a first rotational member and, a second rotational member, said second rotational member being in frictional and rotatable engagement with said first rotational member, said first rotational member and said second rotational member being capable of rotation about a common axis and in parallel planes, said first rotational member including a pair of spaced planar members and a connecting rod member fixed to said spaced flange members, friction means encompassing and frictionally engaging said connecting rod member, and compression means in circumferential engagement with said friction means for selectively varying the compression force on said friction means and consequently selectively varying the frictional force applied to said connecting rod, whereby the force required to cause rotation of said first rotational member relative to said second rotational member is selectively varied.

3. The structure of claim 1, wherein said first rotational member and said second rotational member have adjacent beveled edges and a tab member extending from each beveled surface and overlying the adjacent beveled surface of the other rotational member, whereby upon rotation of said first rotational member relative to said second rotational member, the tab member interacts and limits relative rotation to under 360°.

* * * * *